United States Patent [19]

Gilad

[11] 4,331,294

[45] May 25, 1982

[54] SPRAY OR ATOMIZING NOZZLE

[75] Inventor: Yigal Gilad, Tel Aviv, Israel

[73] Assignee: Irritech, Advanced Irrigation Technologies, Tel Aviv, Israel

[21] Appl. No.: 86,065

[22] Filed: Oct. 18, 1979

[30] Foreign Application Priority Data

Oct. 30, 1979 [IL] Israel ..... 55827

[51] Int. Cl.[3] ..... B05B 1/26

[52] U.S. Cl. ..... 239/222.17; 239/454; 239/467

[58] Field of Search ..... 239/453–456, 239/460, 467, 468, 469, 506, 513, 514–516, 518, 524, 380–383, 222.17

[56] References Cited

U.S. PATENT DOCUMENTS

| | | | |
|---|---|---|---|
| 599,330 | 2/1898 | Hale | 239/524 X |
| 1,667,943 | 5/1928 | Munz | 239/467 X |
| 1,880,880 | 10/1932 | Dietsch | 239/383 |
| 2,116,879 | 5/1938 | Day | 239/382 |
| 2,247,897 | 7/1941 | Wahlin | 239/468 |
| 2,422,059 | 6/1947 | Wilber | 239/453 |
| 2,639,191 | 5/1953 | Hruby, Jr. | 239/222.17 X |
| 2,848,276 | 8/1958 | Clearman | 239/382 |
| 2,949,241 | 8/1960 | Slonim | 239/383 |
| 3,006,558 | 10/1961 | Jacobs | 239/383 X |
| 3,069,099 | 12/1962 | Graham | 239/453 |
| 3,326,473 | 6/1967 | Wahlin | 239/468 |
| 3,958,760 | 5/1976 | Rosenberg | 239/524 X |
| 4,165,038 | 8/1979 | Kumazawa | 239/516 X |

FOREIGN PATENT DOCUMENTS

| | | |
|---|---|---|
| 1010480 | 6/1952 | France . |
| 812423 | 4/1959 | United Kingdom . |

*Primary Examiner*—Andres Kashnikow

*Attorney, Agent, or Firm*—Michael N. Meller; Anthony H. Handal

[57] ABSTRACT

A spray or atomizing nozzle is provided. The nozzle comprises a vortex chamber, an outward-flaring outlet orifice and a movable spray-control body. The spray-control body, in the non-operative state of the nozzle, rests on the flaring rim of said outlet orifice, while in the operative state the spray-control body, being impacted by the liquid issuing from the outlet orifice, is slightly lifted off the flaring rim of the outlet orifice, facilitates deflection of the impacting liquid outwards and produces a droplet spraying effect. Due to the negative-pressure zone created in the vortex chamber, the spray control body is maintained floating in a position of equilibrium at a close distance from the orifice rim, whereby the droplet-size spectrum of said spray is controlled.

12 Claims, 26 Drawing Figures

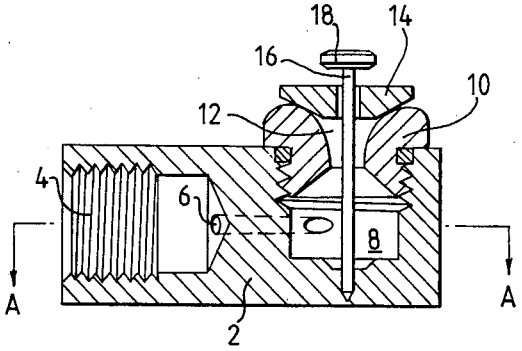
Fig. 1.
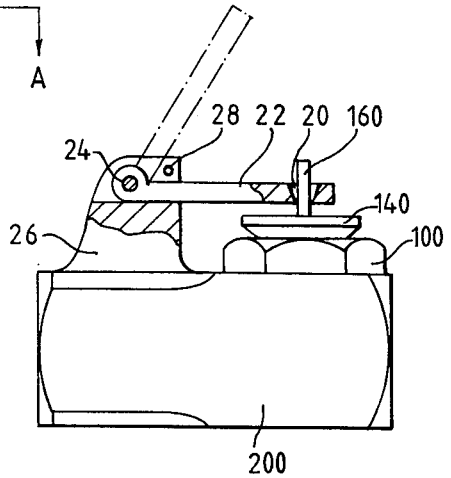
Fig. 3.
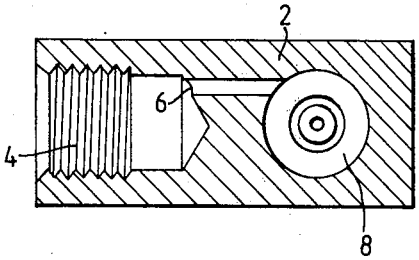
Fig. 2.
Fig. 8.
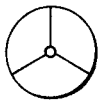
Fig. 9.
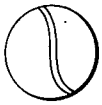
Fig. 10.
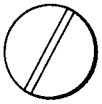
Fig. 11.
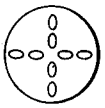
Fig. 12.
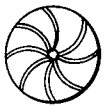

Fig. 4.
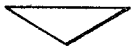
Fig. 5.
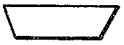
Fig. 6.
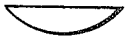
Fig. 7.
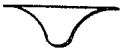
Fig. 13.
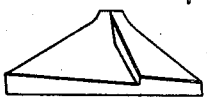
Fig. 14.
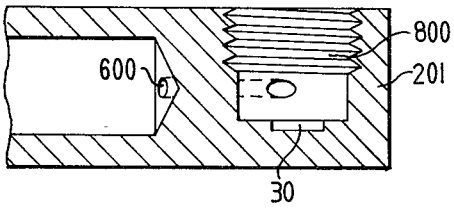
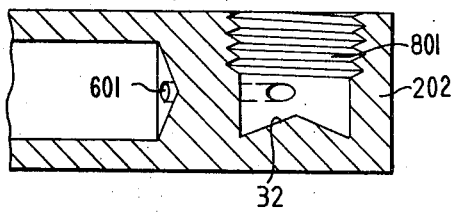
Fig. 15.
Fig. 16.
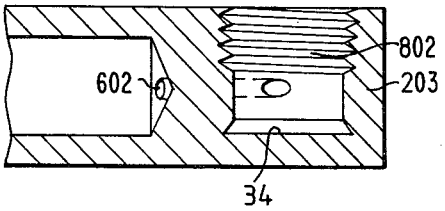
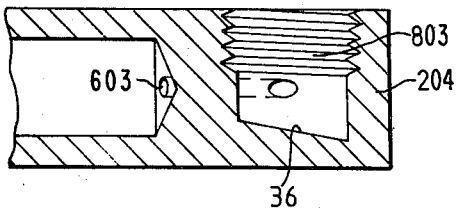
Fig. 17.

SPRAY OR ATOMIZING NOZZLE

The present invention relates to a spray or atomizing nozzle to be used for any agricultural, industrial or other purpose.

Spray nozzles working by the deflection-plate principle are known. In these nozzles, a liquid jet of relatively narrow cross section is made to impinge on an object substantially larger in area than the cross section of the jet. Hitting this obstacle, the liquid particles are deflected outwards, falling to the ground over a roughly annular area. A typical nozzle of this kind is taught by Isreali Application No. 45916, which provides a spraying device comprising a nozzle formed with an outlet orifice through which the fluid issues in the form of a jet, and a deflector supported close to, and in alignment with, the nozzle orifice, so as to be impinged by the jet issuing therefrom.

While this spray nozzle has the advantage of relative simplicity, it still exhibits the major drawback of all known deflector-type nozzles: the problematic interdependence of "throw", i.e., the radius of the area irrigated by a single nozzle, and the size of the liquid droplets producing this throw. Although, by proper selection of the nozzle parameters, it is possible to maximize throw for a given mains pressure, it turns out that, with this prior-art nozzle and its likes, increasing throw will invariably result in a larger proportion of small droplets, and, consequently, in increased evaporation. In common agricultural applications such evaporation constitutes not only a waste of valuable water resources but, in case of spraying toxic materials such as pesticides, is also hazardous to the operator and the environment.

There are also known vortex nozzles in which the liquid jet, before leaving the nozzle, is imparted a twirling motion. This motion, together with the flaring shape of the outlet orifice, causes the liquid to leave the nozzle in the form of a very thin, funnel-like "sheet" which towards its outer edges, breaks up into very fine, almost cloud-like droplets, again resulting in substantial evaporation losses. Still finer droplets are produced directly above the outlet orifice.

However, in applications apart from irrigation, evaporation is not always an undesirable phenomenon. Indeed, some industrial processes such as, for instance, spray-drying, are based on the rapid and total evaporation of the liquid phase of a liquid-solid mixture or solution, which is enhanced by the breaking-up of the mixture or solution into extremely fine droplets. Now, while the prior-art nozzles as above described are unable to produce a droplet-size spectrum that is free of the fine component undesirable for irrigation and some other agricultural purposes, they are equally unable to produce a droplet-size spectrum that is free of the coarse component undesirable for such industrial purposes as spray-drying as well as for certain chemical spraying.

It is one of the objects of the present invention to overcome these drawbacks and difficulties and to provide a non-clogging spray or atomizing nozzle which is characterized by its controllable droplet-size spectrum, permitting its use either for irrigation or similar purposes where fines drift causing evaporation losses is undesirable, or for other, e.g., industrial purposes, where maximum atomizing is indicated.

According to the invention, this is accomplished by providing a spray or atomizing nozzle, comprising a vortex chamber, an outward-flaring outlet orifice and a movable spray-control body, which spray-control body, in the non-operative state of said nozzle, rests on the flaring rim of said outlet orifice, while in the operative state said spray-control body, being impacted by the liquid issuing from said outlet orifice, is slightly lifted off the flaring rim of said outlet orifice, facilitates deflection of the impacting liquid outwards and produces a spraying effect, and wherein said spray-control body, due to the negative-pressure zone created in said vortex chamber, is maintained floating in a position of equilibrium at a close distance from said orifice rim.

While the invention will now be described in connection with certain preferred embodiments, it will be understood that it is not intended to limit the invention to these particular embodiments. On the contrary, it is intended to cover all alternatives, modifications and equivalent arrangements as may be included within the scope of the invention as defined by the appended claims.

Nevertheless, it is believed that embodiments of the invention will be more fully understood from a consideration of the following illustrative description read in conjunction with the accompanying drawings, in which:

FIG. 1 is a cross-sectional view of a first embodiment spray or atomizing nozzle according to the invention;

FIG. 2 is a cross-sectional view, in the plane AA, of the embodiment according to FIG. 1;

FIG. 3 shows another embodiment of the invention;

FIGS. 4 to 7 show some possible profiles of the active face of the spray-control body according to the invention;

FIGS. 8 to 12 are plan views of the active faces of some embodiments of the spray-control bodies;

FIG. 13 is a side view of the spray-control body according to FIG. 8;

FIGS. 14 to 17 show different configurations of vortex-chamber bottoms;

Figure 18:
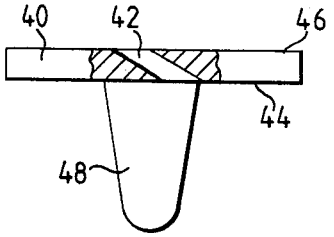
FIGS. 18 and 19 are a frontal and top view, respectively, of a swirl plate.

There is shown in FIG. 1 a first embodiment of the spray or atomizing nozzle according to the invention. Liquid enters the body 2 of the nozzle through the inlet opening 4, threaded to accept a pipe socket (not shown). From this inlet opening 4, the liquid enters a relatively small bore 6, through which it passes into the vortex chamber 8. As is seen to better advantage in FIG. 2, a sectional view along the plane AA, the bore 6 is off center to such a degree that the liquid will enter the vortex chamber 8 in a substantially tangential direction, producing a swirling motion. Above the point where the bore 6 penetrates the vortex chamber 8, the latter is partly closed off by an orifice sleeve 10, leaving open only an outward-flaring outlet orifice 12 of a diameter smaller than, or equal to, the diameter of the vortex chamber 8.

The device as described so far constitutes a vortex nozzle, as such known and producing a very thin "sheet" of liquid fanning out from the outlet orifice. At some distance from the orifice, this "sheet" tends to disintegrate into very small liquid particles, a not insubstantial proportion of which, especially in hotter climates, are liable to evaporate even before reaching the ground. An even finer mist is produced directly above the outlet orifice.

This situation is, however, radically changed, if this vortex nozzle is equipped with a spray-control body 14. In the non-operative state of the nozzle, this spray-control body 14 rests on the flaring rim of the outlet orifice 12, as shown in FIG. 1, covering the orifice and, thereby, preventing fouling. When the spray nozzle is operated, the spray-control body 14, being impacted by the liquid-issuing from the orifice 12, is slightly lifted off the flaring rim of the orifice 12, facilitates deflection of the impacting liquid outwards and produces a spraying effect which differs from that produced by the known nozzles in that both the throw and the mean droplet size are larger. It appears that the spray-control body 14, "riding" on the rotating liquid, and being itself set into rotary motion by the impacting liquid, causes the coherent "sheet" of liquid to break up much earlier and the droplets formed to consolidate, without a perceptible loss in kinetic energy. Larger droplets are better able to overcome air resistance and, thus, produce larger throw. Containing more water, they will not evaporate in midair, thus, reducing evaporation losses.

It was also found that, during operation, the spray-control body is not thrown off by the liquid, as one might assume, but is maintained floating in a position of equilibrium at a certain distance from the orifice rim, even without any retaining means. Moreover, increasing the weight of the spray-control body 14 causes the latter to closer approach the rim of the orifice 12 and produces a larger throw and a finer spray. Instead of increasing the weight, a biasing spring could be used. Furthermore, the spray-control body 14 is automatically kept centered with respect to the outlet orifice 12. This surprising effect is due to certain fluid-dynamical phenomena which produce a vacuum or negative-pressure zone immediately below the spray-control body 14. Still, as these effects obtain only when the spray nozzle operates, retaining and guiding means are required to prevent the spray-impact body 14 from being dislodged, in the nonoperative state of the nozzle, from its position relative to the outlet orifice 12. These means may include a slender rod 16, centrally arranged in the outlet orifice 12, its lower end fixed in the nozzle body 2. The retaining rod 16 passes with clearance through a hole in the center of the spray-control body 14 and carries a head 18 at its upper end, which head 18 serves as a retaining stop to the spray-control body 14. For purpose of cleaning and changing orifice sleeves 10 and/or spray-control bodies 14, the head 18 is removable. The orifice sleeve 10 may be provided with a hexagonal head and has a threaded body which fits the inside thread provided in the vortex chamber 8. Other fastening means can be provided instead of threads, such as, snap-in means. The nozzle body 2 and the orifice sleeve 10 as well as the rest of the nozzle components can be made of any suitable material.

It should be noted that the spray nozzle according to the invention will work in all positions, upright, slanted and upside down. In the latter two positions, it might be necessary to use a restoring spring urging the spray-control body against the orifice rim, to initiate spraying action based on the above-described suction effect.

FIG. 3 shows another preferred embodiment of the spray nozzle according to the invention. In this embodiment, the outlet orifice 12 (FIG. 1) is unencumbered by the retaining rod 160, as this rod is now part of the spray-control body 14 and extends not downwards into the vortex chamber, but upwards, being guided in a suitably dimensioned hole 20 in an arm 22 pivotable about a pivot 24. The pivot end of the arm 22 is seated in a slot in a boss 26 attached to, or part of, the nozzle body 200. For, e.g., cleaning of the nozzle, the arm 22 can be swung out of the way as indicated in FIG. 3 by the dashed lines, whereupon the spray-control body 140 can be removed and the orifice sleeve 100 unscrewed. A suitably shaped pair of nibs 28 (one nib on each side of the arm 22) retains the arm 22 in its swung-down working position. Being free of the central retaining rod 160, the orifice 12 in this embodiment is more efficient. It should be understood that other means for removably retaining the spray-control body 140 can also be used.

Apart from mains pressure, the main factor determining nozzle performance is the size, weight and general configuration of the spray-control body. FIGS. 4 to 7 show some preferred basic non-planar profiles of the spray-control body according to the invention. The geometries of the profiles shown in FIGS. 4 to 6 are, respectively, those of a cone, a cone frustrum and convex. The geometry of the spray-control body profile shown in FIG. 7 is also substantially that of a cone, but with a generatrix which is not a straight line, but a curve. It should, however, be pointed out that either a flat or a non-concave configuration, or a combination of any of the shapes shown in FIGS. 4 to 7 equally fall within the scope of the present invention.

While a spray-control body having the smooth, simple surface of one of the shapes indicated in FIGS. 4–7 gives satisfactory results, it has been found that performance is greatly enhanced when the active face of the spray-control body is provided with either protruding or recessed features, that is, either with ridge- and/or step-like projections, or with dimple- and/or groove-like recesses. FIGS. 8 to 13 show some of the many possible face configurations. A burr-like configuration with a plurality of steps or "teeth" is shown in FIG. 8, with a side view giving a better idea of the actual shape shown in FIG. 13. FIGS. 9 and 10 show simple grooves (or ridges) either curved or straight. FIG. 11 shows an active face with a plurality of dimple-like recesses (or protrusions) and FIG. 12 is a curved, multiple-groove (or ridge) configuration. Recesses and projections may also be mixed. Whereas the edges of the spray-control bodies shown in FIGS. 8 to 13 are cylindrical and smooth, an additional effect is obtained by having them milled, knurled or otherwise serrated, or giving them a corrugated or polygonal shape.

A further factor affecting nozzle performance is the size and general configuration of the outlet orifice 12. As already mentioned, the embodiments shown in FIGS. 1 and 3 permit easy changing of the orifices. However, embodiments are conceivable, in which the outlet orifice 12 would be an integral part of the nozzle body 2. In such cases the orifice could be varied by providing a set of snap-in inserts, not shown and as such known, which could optionally alter the size and/or shape of the inlet orifice.

As a general rule, it can be stated that the closer the match between the respective surfaces of outlet orifice and spray-control body, the smaller the working clearance between them, the larger the throw and the better the operating stability.

A still further factor affecting nozzle performance as regards output and spray pattern is the geometry of the vortex-chamber bottom. FIGS. 14 to 17 show some examples of such geometries. In FIG. 14, vortex chamber 800 of body 201 has a bottom with a substantially cylindrical recess 30. Liquid passes into vortex chamber 800 through bore 600. In FIG. 15, vortex chamber 801 of body 202 has a re-entrant bottom 32. Liquid passes into vortex chamber 801 through bore 601. In FIG. 16, vortex chamber 802 of body 203 has a bottom with undercut edges 34. Liquid flows into vortex chamber 802 through bore 602. In FIG. 17, vortex chamber 803 of body 204 has a slanting bottom 36. Liquid flows into vortex chamber 803 through bore 603. All other parameters being equal, it has been experimentally established that the highest outputs are achievable with nozzles with vortex-chamber bottom geometries according to FIG. 15 and FIG. 16.

Figure 19:
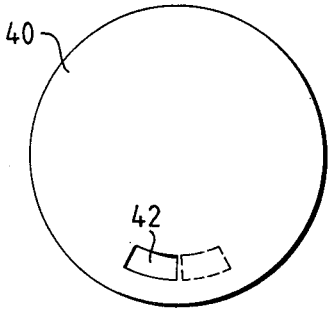

While in the embodiments shown and described so far, the vortex has been produced by a small, off-center bore 6 (FIG. 2) through which the water is introduced into the vortex chamber 8 in a tangential direction, there are many other arrangements available, by means of which the required vortex can be produced. FIGS. 18 and 19 show a front and plan view, respectively, of a circular swirl plate 40 comprising an off-center duct 42 starting at some point at the underside 44 of the plate 40 and, rising helically, emerging at an angularly offset point at the upper side of the plate 40. An impact cone 48, part of the swirl plate 40, deflects the impacting water from the center of the plate 40 to the peripheral zone in which the helical duct is located. As is obvious from FIGS. 18 and 19, the geometry of the duct 42 is such that, when properly mounted (FIG. 20), the water coming from below and passing through it at a high velocity, is being imparted not only a swirling, but, due to the helicality of the duct 42, also an axially rising motion which enhances the spraying effect. Although the swirl plate 40 shown has only one helical duct 42, such plates can have two or more such helical ducts arranged along one common imaginary cylinder or along two or more of such, e.g., concentrically arranged imaginary cylinders.

It is clear that the swirl plate 40 will also function without the impact cone 48, especially in case of several concentrically arranged helical ducts. It is also clear that the ducts 42 need not be parts of a true helix, but may be, e.g., tangents to such a true helix.

Figure 20:
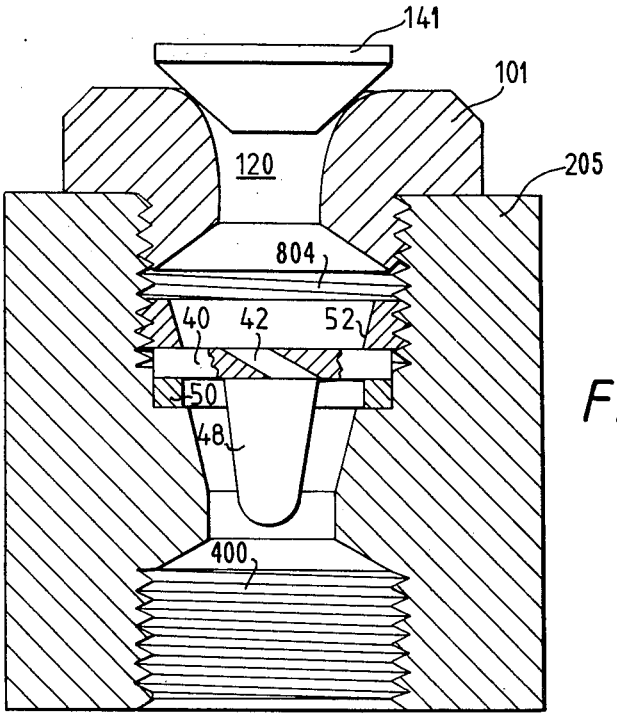
FIG. 20 is a cross-sectional view of a spray nozzle according to the invention, using a swirl plate according to FIGS. 18 and 19.

FIG. 20 shows such a swirl plate 40 in position in a spray nozzle according to the invention. Seen is the nozzle body 205 with its inlet 400 and with its vortex chamber 804. The swirl plate 40 is seated on a sealing ring 50 located at the bottom of the chamber 804 and is held down by a clamping ring 52. As in the embodiments shown in FIGS. 1 and 3, the vortex chamber 804 is closed by the orifice sleeve 101, leaving open only the outlet orifice 120 on which, in the non-operative state, there is seated the spray-control body 141. The retaining rod 16, 160 (FIGS. 1 and 3) is not shown, for reasons of clarity. It could conceivably be press-fitted or embedded in the impact cone 48, or the nozzle could be of the type shown in FIG. 3, with the rod 160 being a part of the spray-control body 140, the nozzle body being provided with a pivotable arm 22, as in FIG. 3.

Figure 21:
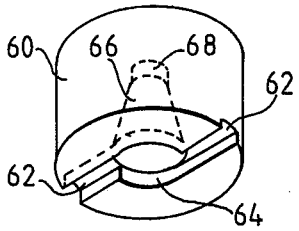
FIG. 21 is a perspective view of another possible swirl plate.
Figure 22:
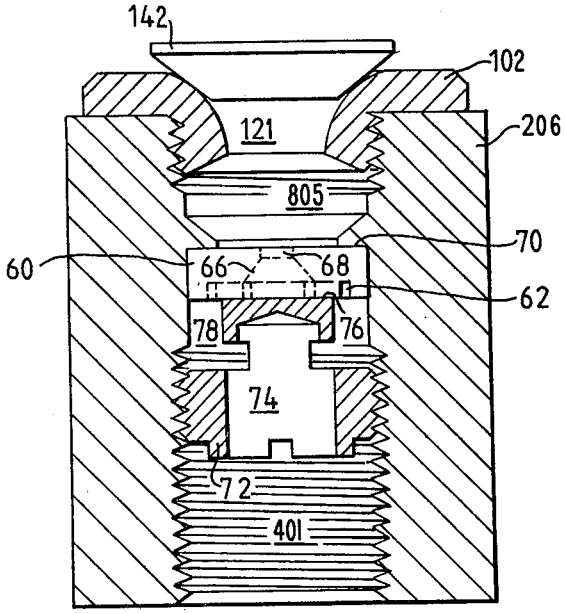
FIG. 22 is a cross-sectional view of a spray or atomizing nozzle using a swirl plate according to FIG. 21.
Figure 23:
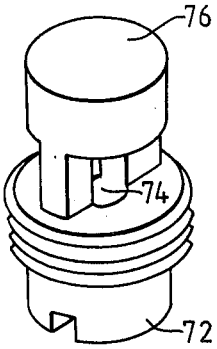
FIG. 23 is an enlarged perspective view of the set screw used to mount the swirl plate of FIG. 21 in the body of the spray nozzle.

Another possible vortex arrangement is seen in FIGS. 21, 22, 23. FIG. 21 shows, in perspective, and seen from below, a swirl plate 60 provided with two inlet grooves 62 which tangentially lead into a cylindrical recess 64 passing into a funnel 66 which, via a short, cylindrical section 68, opens on the other side of the plate 60. The liquid, entering the grooves 62 (of which there may also be more than two) is tangentially led into the recess 64 and, via the funnel section 66 and short, small cylindrical section 68, to the other side of the plate 60, which other side, as can be seen in the assembled nozzle shown in FIG. 22, faces the vortex chamber 805. The tangential entry via the grooves 62 imparts to the liquid the desired swirling motion which it also retains when already in the vortex chamber 805.

FIG. 22 shows the assembled nozzle. The swirling plate 60 is located immediately below the vortex chamber 805, held against an abutment 70 by a special set screw 72, shown in perspective and greatly enlarged in FIG. 23. This set screw 72 is provided with a bore 74 which, however, does not penetrate its top face 76. The upper part of the set screw 72 is of a reduced diameter and substantially cylindrical shape, so that, when screwed home against the swirl plate 60, not only will its top face 76 obturate the entire central section of the swirl plate 60, leaving open and accessible to the liquid only the outer ends of the tangential grooves 62, but, because of the reduced diameter of its upper part, create an annular space 78 (FIG. 22) immediately below the swirl plate 60. Communication between this space 78 and the bore 74 is established by the two slots cut into the reduced section of the screw 72 immediately above the threaded part. These slots are of such a depth that they cut into the bore 74, exposing it to the outside. Water entering the spray nozzle through the inlet opening 401 subsequently enters the bore 74 and reaches the annular space through the cut-open upper part of the bore 74. From the annular space the liquid passes into the exposed ends of the tangential grooves 62 and, being imparted a swirling motion, reaches the vortex chamber 805.

It is also conceivable to provide an integral design in which the orifice sleeve 102 and the swirl plate 60 are of one piece, in which case the outlet orifice 121 serve also as vortex chamber 805.

In another integral design, the set screw member 72 and the housing 206 could be of one piece. Furthermore, by providing the member 72 (either of the design shown in FIG. 22 or of the above proposed integral design) with, for example, a plurality of radial slots along the upper, reduced part of the member 72, instead of the two slots shown in FIGS. 22 and 23, the member 72 would also function as a filter screen, keeping out solid particles such as grit, soil particles or the like. These radial slots would have to be deep enough to break into the bore 74, but leave enough of the top face 76 intact to obturate the central section of the swirl plate 60 or its integral analogue.

Although in FIGS. 20 and 22, the respective spray-control bodies 141 and 142 are shown as freely resting on their respective orifice sleeves 101 and 102, they are advantageously provided with retaining and guiding means for reasons explained in connection with the embodiment shown in FIG. 1. These means can be similar to those shown in FIGS. 1, 3 or 24, or any other means not interfering with the operational principle of the nozzle according to the invention.

Figure 24:
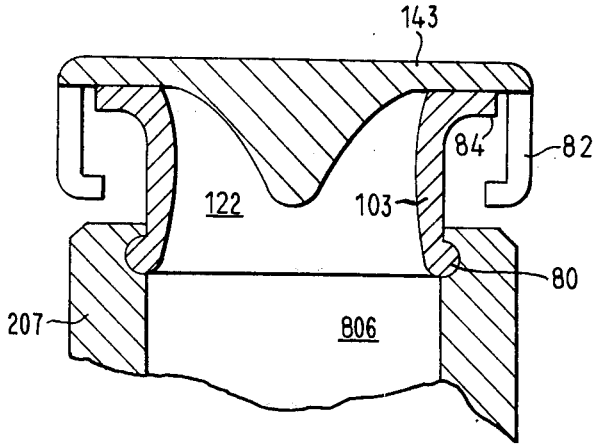
FIG. 24 is a cross-sectional view of yet another embodiment of the spray nozzle according to the invention.

FIG. 24 shows yet another embodiment of the spray nozzle which, from the manufacturing point of view, offers several advantages. The nozzle (shown in its non-operative state) consists of the nozzle body 207, only part of which is shown. Any of the vortex-producing devices described above or otherwise known can be used. The orifice sleeve 103 with outlet orifice 122, preferably but not necessarily made of a plastic material, is provided at its end facing the vortex chamber 806 with a beaded rim 80 which, upon assembly, is made to snap into an appropriately shaped groove in the nozzle body 207, saving the added expenditure of a threaded joint. The spray-control body 143, which can have any of the shapes described above, is provided with a plurality of hook-like fingers 82 which permit it some radial movement to prevent friction and a few millimeters of axial movement, to let it reach its floating position without the bent ends of the fingers 82 making contact with the underside 84 of the rim of the orifice body 103, but otherwise preventing the spray-control body 143 from sliding or falling off the orifice body 103. The retaining rod 16, 160 (FIGS. 1, 3) and its accessories (22-28 in FIG. 3) can, therefore, be dispensed with. The fingers 82 can have any cross section, round, oval, rectangular, or the like. A triangular cross section, at least of the vertical part of the fingers 82, with the triangle vertex pointing radially inward, would have the effect of reducing the inevitable interference of the fingers with the even spreading of the "sheet" of water. Since the spray-control body 143 is rotating as explained above, the retaining fingers 82 have no "shadowing" effect. The fingers 82 could also be used to increase the throw-enhancing rotation of the spray-control body 143. If, for instance, the triangle of the above-mentioned finger cross section were to be oriented in such a way that it would not be symmetrical with respect to the orifice radius passing through its vertex, a turbine-blade effect would be the result, assisting the rotary movement of the spray-control body 143.

Figure 25:
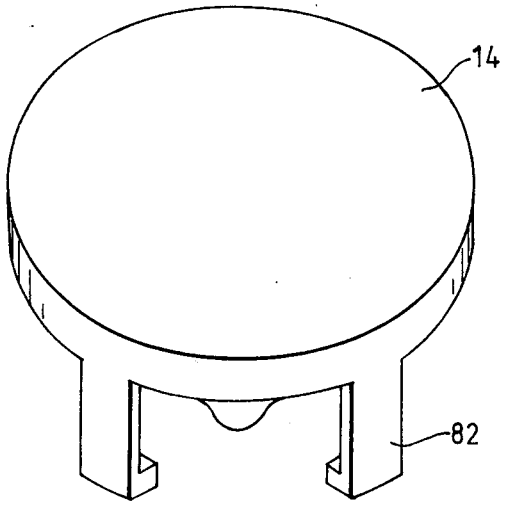
FIG. 25 is a perspective view of the spray-control body of the embodiment of FIG. 24.

FIG. 25 is a perspective view of a spray-control body 14 having, e.g., three retaining fingers 82 (of which only two are visible). Whatever their configuration, these fingers 82 must have some degree of elasticity, so that they can be flexed enough to slip over the rim of the orifice body 103, as the ends of the bent portions of these fingers 82 are parts of, or tangent to, a circle the diameter of which is substantially smaller than the diameter of the outlet-side rim of the orifice body 103.

Figure 26:
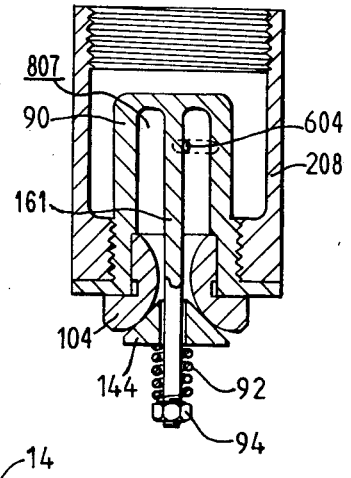
FIG. 26 is a cross-sectional view of a further embodiment of the spray nozzle according to the invention, designed for use also in the upside-down position.

FIG. 26 shows a further embodiment of the spray nozzle, particularly suitable for use in the upside-down position, or in oblique positions of any angle. Seen is the body 208, a tubular member provided with an internal thread at each of its ends, one of which is connected to the supply line. Into the other end is screwed a vortex insert 90 surrounding the vortex chamber 807 and comprising at least one, but possible two or more tangential inlet bores 604 through which the liquid enters the chamber 807 and the tangentiality of which produces the required vortex. Also provided is a central rod 161 preferably, but not necessarily integral with the vortex insert 90 which passes through a central bore in the spray-control body 144. This bore is large enough to permit, during operation of the nozzle, free longitudinal and rotational movement of the spray-control body 144, but not large enough to permit some of the liquid to pass through the clearance, or to interfere with the low-pressure zone produced by the vortex. A light spring 92 below the spray-control body 144 facilitates control of the droplet-size spectrum of the nozzle in the operation state of the latter by exerting variable pressures on the spray-control body 144, and keeps the nozzle closed when not in operation, by forcing the spray-control body 144 against the orifice sleeve 104. The spring 92 is adjusted and retained by a nut 94.

This embodiment is particularly suitable for use in glass-or hothouses, as air humidifier, or for agricultural spraying from airplanes.

It will be evident to those skilled in the art that the invention is not limited to the details of the foregoing illustrative embodiments and that the present invention may be embodied in other specific forms without departing from the essential attributes thereof, and it is, therefore, desired that the present embodiments be considered in all respects as illustrative and not restrictive, reference being made to the appended claims, rather than to the foregoing description, in which it is intended to claim all modifications coming within the scope of the invention.

What is claimed is:

1. A spray or atomizing nozzle, comprising a vortex chamber, an outward-flaring outlet orifice and a rotatable spray-control body, which spray-control body, in the non-operative state of said nozzle, rests on the flaring rim of said outlet orifice, while in the operative state said spray-control body, being impacted by the liquid issuing from said outlet orifice, is slightly lifted off the flaring rim of said outlet orifice, facilitates deflection of the impacting liquid outwards, produces a droplet spraying effect and, due to the negative-pressure zone created in said vortex chamber, is maintained floating in a position of equilibrium at a close distance from said orifice rim, whereby the droplet-size spectrum of said spray is controlled.

2. The spray nozzle as claimed in claim 1, wherein said spray-control body has at least one non-planar, active face which, in the non-operative state of said nozzle rests on the flaring rim of said outlet orifice, said non-planar face of said spray-control body having the effect of centering said movable spray-control body with respect to said outlet orifice.

3. The spray nozzle as claimed in claim 2, wherein the geometry of said non-planar, active face of said spray-control body is substantially that of a cone.

4. The spray nozzle as claimed in claim 2, wherein the geometry of said non-planar, active face of said spray-control body is substantially that of a cone frustrum.

5. The spray nozzle as claimed in claim 2, wherein the geometry of said non-planar, active face of said spray-control body is substantially convex.

6. The spray nozzle as claimed in claim 2, wherein the active face of said spray-control body is provided with a plurality of ridge- and/or step-like projections extending from points closer to the center of said active face and having a throw-enhancing and droplet-consolidating effect.

7. The spray nozzle as claimed in claim 2, wherein the active face of said spray-control body is provided with a plurality of dimple-and/or groove-like recesses extending from points closer to the center of said active face towards points closer to the edge of said active face and having a throw-enhancing and droplet-consolidating effect.

8. The spray nozzle as claimed in claim 1, wherein retaining means are provided to prevent said spray-control body from being dislodged, in the non-operative state of said nozzle, from its position relative to said outlet orifice.

9. The spray nozzle as claimed in claim 8, especially adapted for a downward-directed spraying or atomizing, wherein biasing means are provided which, in conjunction with said retaining means controls the droplet-size spectrum of said nozzle when in the operational state, and keeps said nozzle closed when not in operation.

10. The spray nozzle as claimed in claim 1, wherein said orifice body is attachable to said nozzle body by means of a snap-in joint.

11. The spray nozzle as claimed in claim 1, wherein said spray-control body is provided with a plurality of hook-like fingers, the ends of the bent portions of which are parts of, or tangent to, an imaginary circle the diameter of which is substantially smaller than the outlet-side rim of said orifice body.

12. The spray nozzle as claimed in claim 11, wherein the horizontal cross section of at least the vertical portion of said hook-like fingers is of such a shape as to minimize interference with the liquid issuing from said outlet orifice.

* * * * *